US006835902B2

(12) United States Patent
Hiraoka

(10) Patent No.: US 6,835,902 B2
(45) Date of Patent: Dec. 28, 2004

(54) PERIPHERAL AND CENTRAL KEY APPARATUS

(75) Inventor: Jun Hiraoka, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/373,960

(22) Filed: Feb. 27, 2003

(65) Prior Publication Data

US 2003/0164281 A1 Sep. 4, 2003

(30) Foreign Application Priority Data

Mar. 1, 2002 (JP) ..... 2002-056186

(51) Int. Cl.[7] ..... H01H 3/26
(52) U.S. Cl. ..... 200/5 A; 200/200; 200/343
(58) Field of Search ..... 200/5 A, 343, 200/18, 341, 345

(56) References Cited

U.S. PATENT DOCUMENTS 4,311,893 A * 1/1982 Tsuchiya et al. ..... 200/5 A
4,315,114 A * 2/1982 Monti, Jr. ..... 200/343
4,582,967 A * 4/1986 Brumit et al. ..... 200/343
6,552,282 B2 * 4/2003 Lewis ..... 200/5 A

FOREIGN PATENT DOCUMENTS

JP 2001-266697 A 9/2001

* cited by examiner

*Primary Examiner*—Renee Luebke
(74) *Attorney, Agent, or Firm*—Birch, Stewart, Kolasch & Birch, LLP

(57) ABSTRACT

A key device has a plurality of peripheral key tops arranged around a center key top so that the key tops, when pressed, operate switches arranged below them respectively. The center key top is essentially supported by center hinges extending from a center frame provided around the center key top, and the peripheral key tops are provided above the center frame and are each elastically supported by peripheral hinges extending from a peripheral frame provided around the peripheral key tops.

10 Claims, 11 Drawing Sheets

PERIPHERAL AND CENTRAL KEY APPARATUS

BACKGROUND OF THE INVENTION

1. Field of the Invention

The present invention relates to a key device having a plurality of peripheral key tops arranged closely around a center key top so that those key tops, when pressed, operate switches and thus serve as push buttons.

2. Description of the Prior Art

FIG. 15 is an exploded perspective view of a conventional key device. The key device 100 has a plurality of peripheral key tops 102 arranged around a circular center key top 101. Below the center key top 101 and the peripheral key tops 102, there are provided push switches (not shown) one for each key top. Each peripheral key as defined in the prior art of the disclosure is in the shape of a circular portion which has an inner circular shape and an outer circular shape. The inner circular shape is adjacent to the circular center key top.

Around the peripheral key tops 102, there is provided a ring-shaped peripheral frame 104 that is fixed to a circuit board (not shown). Each peripheral key top 102 is linked to the peripheral frame 104 by two peripheral hinges 103. Thus, the peripheral key tops 102 are elastically supported so as to be movable up and down.

The center key top 101 has a recessed edge at the top so that it is prevented from dropping off by a panel cover (not shown) with a hole so sized as to cover the shoulder portion 101*a*, i.e., the lower-step portion, of the center key top 101 and expose the exposed portion 101*b*, i.e., the upper-step portion, thereof. The center key top 101 is movable up and down thanks to the resilience of the push switch provided below it.

In the key device 100 structured as described above, the center key top 101 can freely move radially and rotate owing to the gap between the exposed portion 101*b* thereof and the hole of the panel cover. Thus, when operated, the center key top 101 may rotate and incline into a lopsided position. This spoils operability and appearance.

To solve this problem, the applicant of the present invention once proposed, in Japanese Patent Application Laid-Open No. 2001-266697, a key device provided with a supporter for supporting the center key top 101. In this key device, as shown in FIG. 16, below the center key top 101, there is provided a supporter 107 having the same shape as the center key top 101 as seen in a plan view.

Moreover, the center key top 101 is elastically supported by a center hinge 106 that extends circumferentially from the top of the supporter 107. This prevents the center key top 101, located at the center of the peripheral key tops 102 (see FIG. 5), from moving as seen in a plan view, and thus helps achieve satisfactory operability and appearance.

However, in the key device described above, in which the center key top 101 is provided with the supporter 107, the supporter 107 needs to be arranged three-dimensionally with respect to the center key top 101. This complicates the shape of the mold used, and also complicates the molding process, resulting in the comparatively high costs of the key device.

SUMMARY OF THE INVENTION

An object of the present invention is to provide a key device that can be produced at lower costs and that offers improved operability and appearance.

To achieve the above object, according to the present invention, in a key device having a plurality of peripheral key tops arranged around a center key top so that the key tops, when pressed, operate switches arranged below the key tops respectively, the center key top is elastically supported by a center hinge extending from a center frame provided around the center key top, and the peripheral key tops are provided above the center frame and are each elastically supported by a peripheral hinge extending from a peripheral frame provided around the peripheral key tops.

Alternatively, according to the present invention, in a key device having a plurality of peripheral key tops arranged around a center key top so that the key tops, when pressed, operate switches arranged below the key tops respectively, the peripheral key tops are each elastically supported by a peripheral hinge extending from a peripheral frame provided around the peripheral key tops, and the center key top is elastically supported by a center hinge that is linked to the peripheral frame by being laid between adjacent ones of the peripheral key tops.

According to the present invention, in either of the key devices described above, the plurality of peripheral key tops may be integrated together into a single ring-shaped member. In this structure, when part of the peripheral key top member is pressed, it inclines and operates one switch.

According to the present invention, in either of the key devices described above, the center hinge may be arranged along the circumference of the center key top. In this structure, the center hinge is given a sufficient length between the ends thereof to make it easy to elastically support the center key top.

According to the present invention, in either of the key devices described above, a cover for covering the center hinge may be formed so as to extend from the surface of the center key top or of the peripheral key tops.

According to the present invention, in either of the key devices described above, the cover may have an edge thereof so formed as to droop down to form an edge wall. In this structure, when pressed, the center or peripheral key tops go down while being guided by the edge wall.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
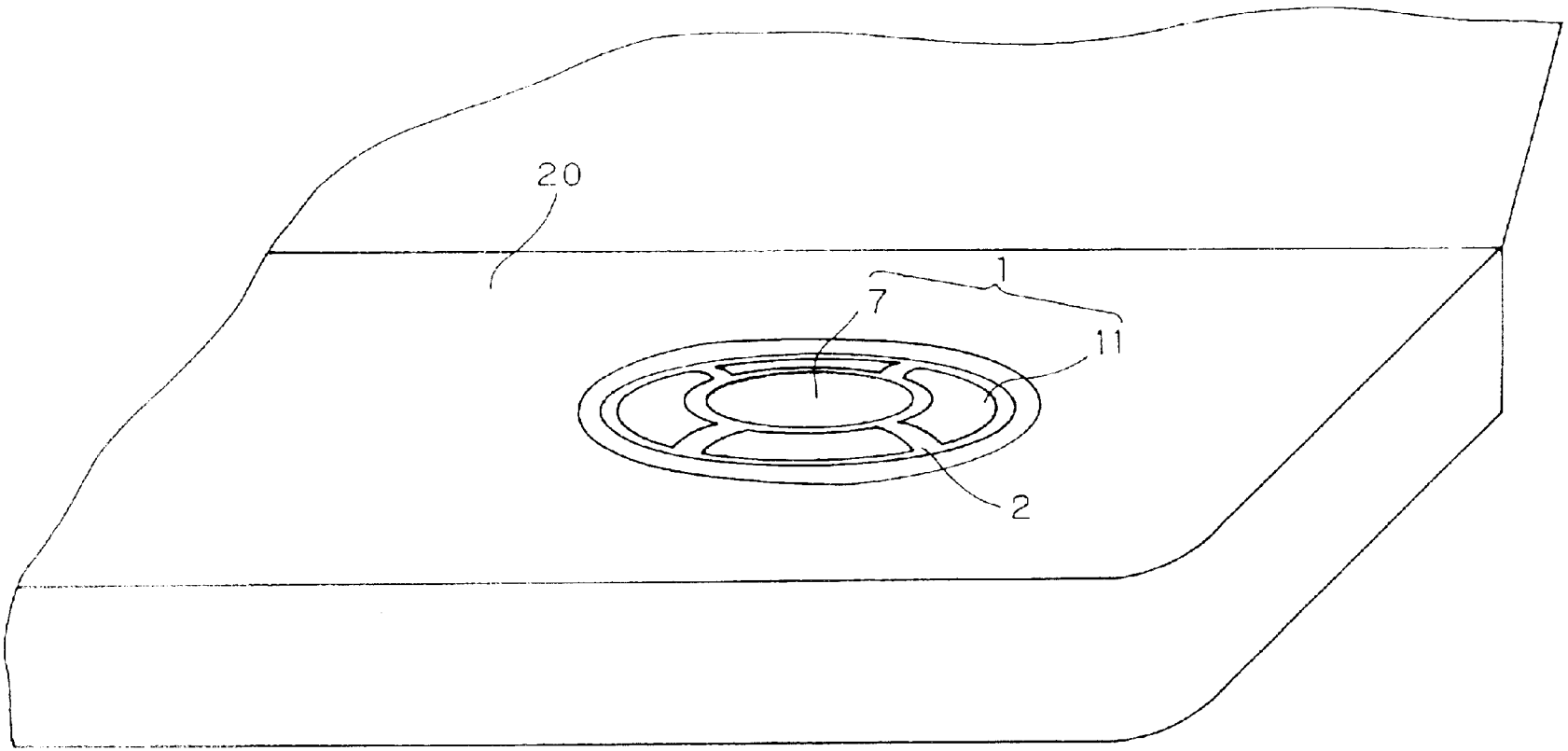
FIG. 1 is a perspective view of a relevant portion of an apparatus incorporating the key device of a first embodiment of the invention.

Hereinafter, embodiments of the present invention will be described with reference to the drawings. FIG. 1 is a perspective view of a relevant portion of an electronic apparatus, such as a facsimile machine, incorporating the key device of a first embodiment of the invention. In an operation portion of the electronic apparatus 20, there is provided a key device 1. The key device 1 has a plurality of peripheral key tops 11 arranged around a center key top 7. The gaps between the center key top 7 and the peripheral key tops 11 and between the peripheral key tops 11 themselves are filled by a panel cover 2 that covers the whole surface of the operation portion of the electronic apparatus 20.

Figure 2:
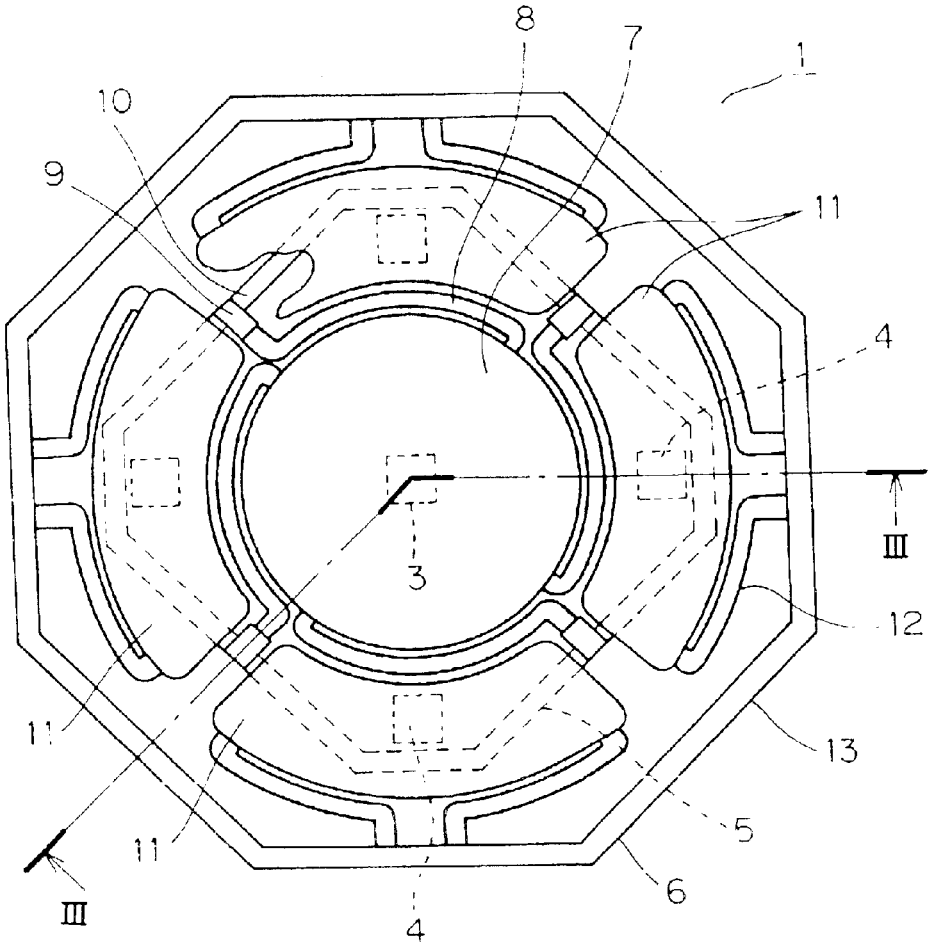
FIG. 2 is a plan view of the key device of the first embodiment.
Figure 3:
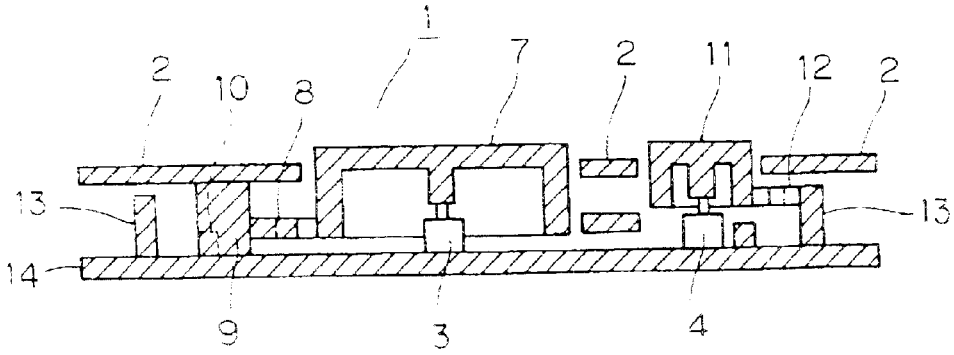
FIG. 3 is a sectional view taken along line III—III shown in FIG. 2.

FIG. 2 is a plan view of the key device 1, and FIG. 3 is a sectional view taken along line III—III shown in FIG. 2. In FIG. 2, the panel cover 2 is omitted. The key device 1 is composed of a center key member 5, having the center key top 7, and a peripheral key member 6, having the peripheral key tops 11, fitted on a circuit board 14. Below the center key top 7 and the peripheral key tops 11, there are arranged push switches 3 and 4 respectively, which are fixed to the circuit board 14.

Figure 4:
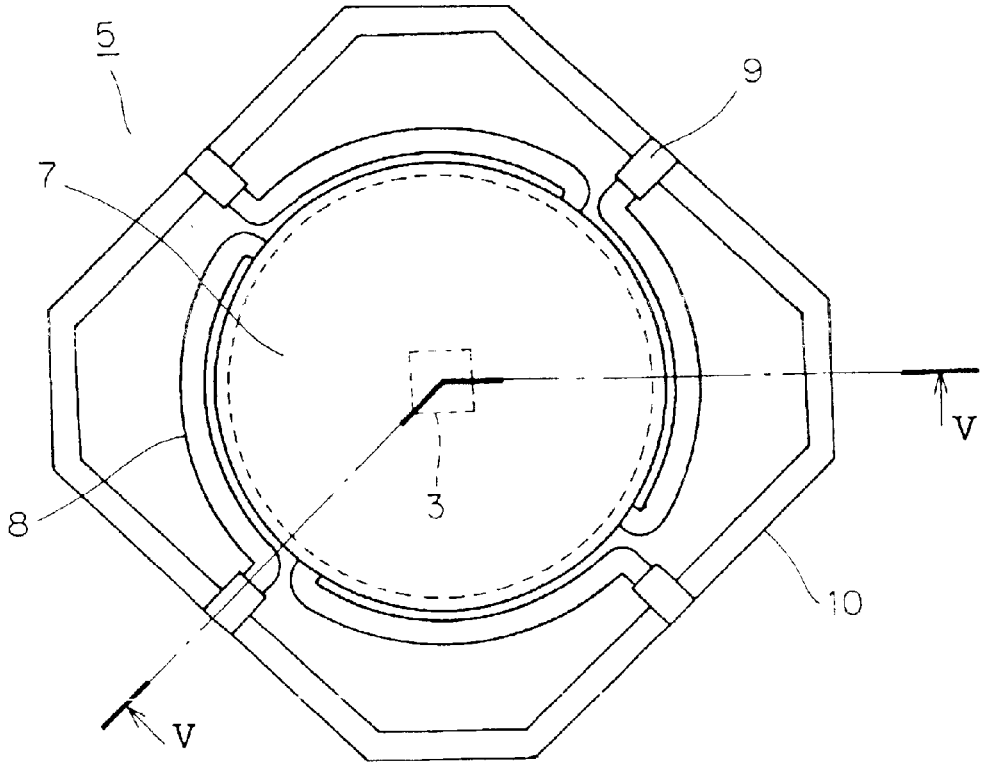
FIG. 4 is a plan view of the center key member of the key device of the first embodiment.
Figure 5:
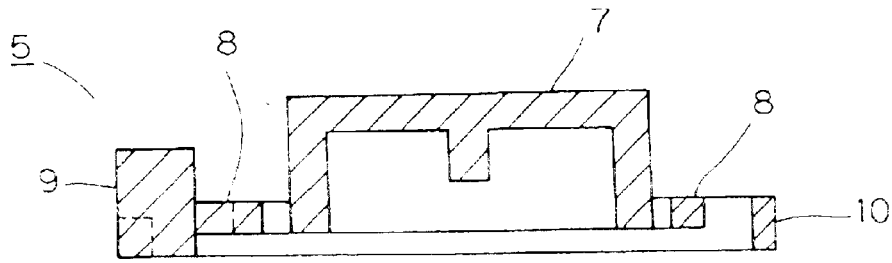
FIG. 5 is a sectional view taken along line V—V shown in FIG. 4.

FIG. 4 is a plan view of the center key member 5, and FIG. 5 is a sectional view taken along line V—V shown in FIG. 5. The center key member 5 has a ring-shaped center frame 10 that is arranged around the center key top 7 and that is fixed to the circuit board 14. On the center frame 10, four arms 9 for supporting the panel cover 2 (see FIG. 3) are formed at equal intervals.

To the arms 9, four center hinges 8 are linked respectively at one end thereof. The center hinges 8 each extend over an angle of about 90° along the circumference of the center key top 7. The center hinges 8 are, at the other end thereof, linked to the circumferential surface of the center key top 7. This permits the center key top 7 to be elastically supported on the center frame 10, and thus permits the center key top 7, when pressed, to operate the push switch 3.

Figure 6:
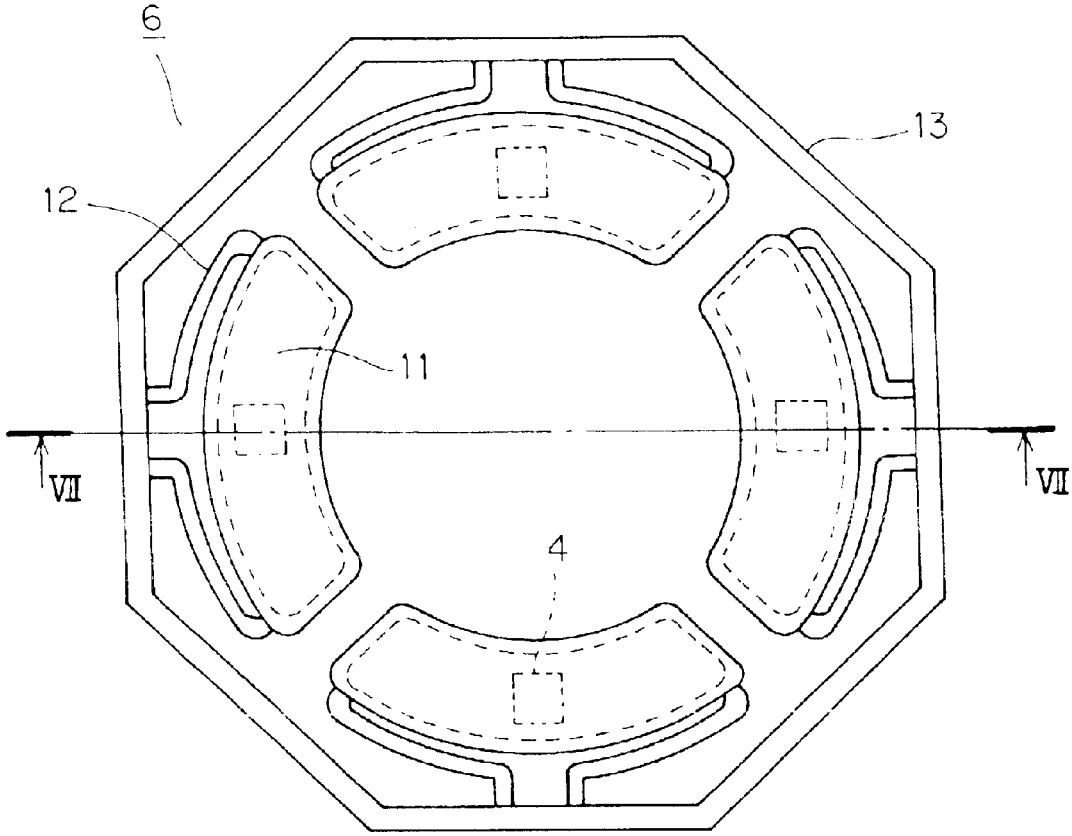
FIG. 6 is a plan view of the peripheral key member of the key device of the first embodiment.
Figure 7:
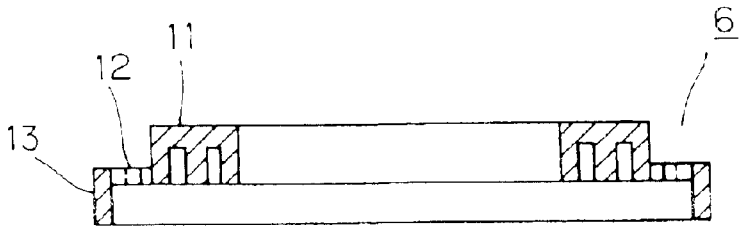
FIG. 7 is a sectional view taken along line VII—VII shown in FIG. 6.

FIG. 6 is a plan view of the peripheral key member 6, and FIG. 7 is a sectional view taken along VII—VII shown in FIG. 6. The peripheral key member 6 has a ring-shaped peripheral frame 13 that is arranged around the peripheral key tops 11 and that is fixed to the circuit board 14. To the peripheral frame 13, in each of four places located at equal intervals, are connected two peripheral hinges 12 that extend along the outer edge of the corresponding one of the peripheral key tops 11. The peripheral hinges 12 are, at the other end thereof, linked to both ends of the corresponding peripheral key top 11. This permits the peripheral key tops 11 to be elastically supported on the peripheral frame 13, and thus permits the peripheral key tops 11, when pressed, to operate the push switches 4.

In FIGS. 2 and 3 described above, the key device 1 is assembled in the following manner. First, the center frame 10 of the center key member 5 is fitted on the circuit board 14, and then the peripheral frame 13 is fitted to the circuit board 14 with the peripheral key member 6 so arranged that the peripheral key tops 11 cover the center frame 10. Then, the panel cover 2 (see FIG. 1) is bonded to the arms 9 to fill the gap between the center hinges 8 and the peripheral key tops 11 surrounding it.

In this way, it is possible to prevent the center key top 7 from moving or rotating as seen in a plan view, and improve the operability and appearance of the key device 1. Moreover, arranging the center frame 10 below peripheral key tops 11 helps save space. Furthermore, no part of the center key member 5 or the peripheral key member 6 is hidden as seen from both above and below. This makes it easy to produce the mold and perform the molding process, resulting in lower component costs.

Figure 8:
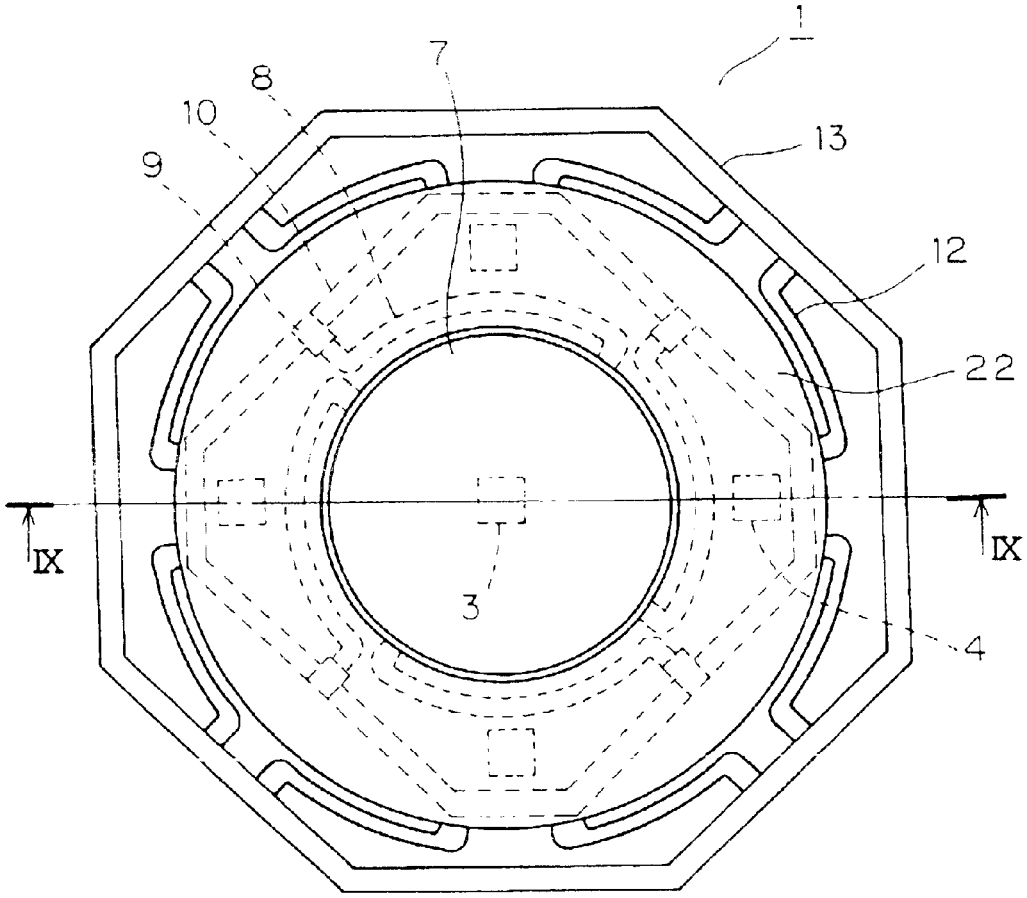
FIG. 8 is a plan view of the key device of a second embodiment of the invention.
Figure 9:
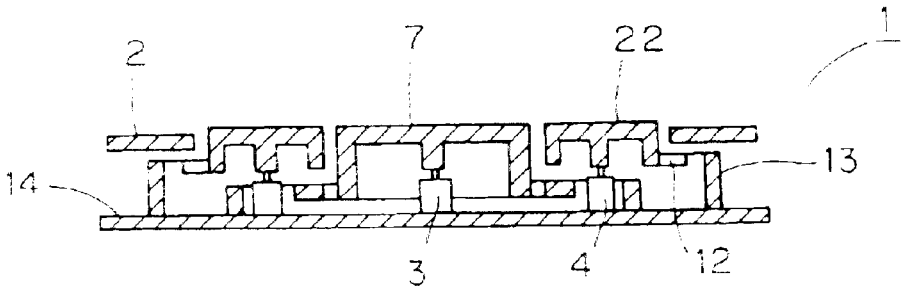
FIG. 9 is a sectional view taken along line IX—IX shown in FIG. 8.

FIG. 8 is a plan view of the key device of a second embodiment of the invention, and FIG. 9 is a sectional view taken along line IX—IX shown in FIG. 8. Here, for convenience' sake, such parts as find their counterparts in the first embodiment shown in FIGS. 1 to 7 and described above are identified with the same reference numerals. This embodiment differs from the first embodiment in the use of a ring-shaped peripheral key top 22. In other respects, the structure here is the same as in the first embodiment.

In this embodiment, when part of the peripheral key top 22 is pressed, it inclines and thereby operates the push switch 4 located where the peripheral key top 22 is pressed. Moreover, as in the first embodiment, the center key top 7 is elastically supported by the center hinges 8 linked to the center frame 10, achieving the same advantages as in the first embodiment.

The peripheral key top 22 is continuous, and therefore does not permit the center hinges 8 to be covered by the panel cover 2. However, the peripheral key top 22 itself can cover the center hinges 8 and thereby prevent exposure thereof. Moreover, it is possible to arrange the peripheral key top 22 and the center key top 7 closer to each other and thereby further enhance the appearance and operability of the key device 1. In the first embodiment also, the peripheral key tops 11 (see FIG. 2) may be so extended as to cover the center hinges 8.

Figure 10:
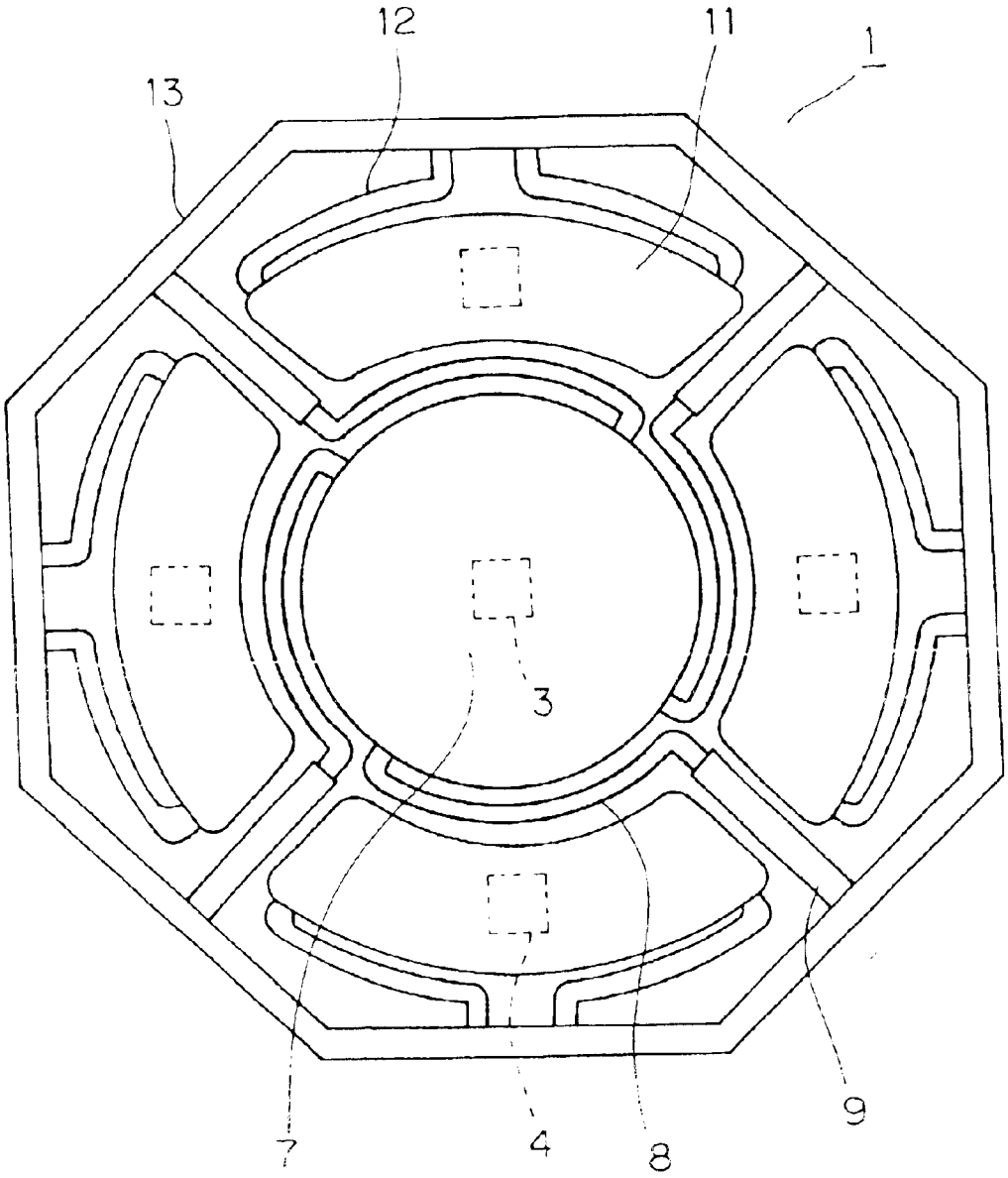
FIG. 10 is a plan view of the key device of a third embodiment of the invention.

FIG. 10 is a plan view of the key device of a third embodiment of the invention. Here, for convenience' sake, such parts as find their counterparts in the first embodiment shown in FIGS. 1 to 7 and described earlier are identified with the same reference numerals. This embodiment differs from the first embodiment in that the center frame 10 (see FIG. 2) is omitted, and that, instead, the arms 9 are formed so as to extend from the peripheral frame 13 and run between adjacent ones of the peripheral key tops 11. In other respects, the structure here is the same as in the first embodiment.

In this embodiment, as in the first embodiment, it is possible to prevent the center key top 7 from moving or rotating as seen in a plan view, and improve the operability and appearance of the key device 1. Moreover, it is possible to integrally form the center key top 7 and the peripheral key tops 11. This helps further reduce component and assembly costs.

Figure 11:
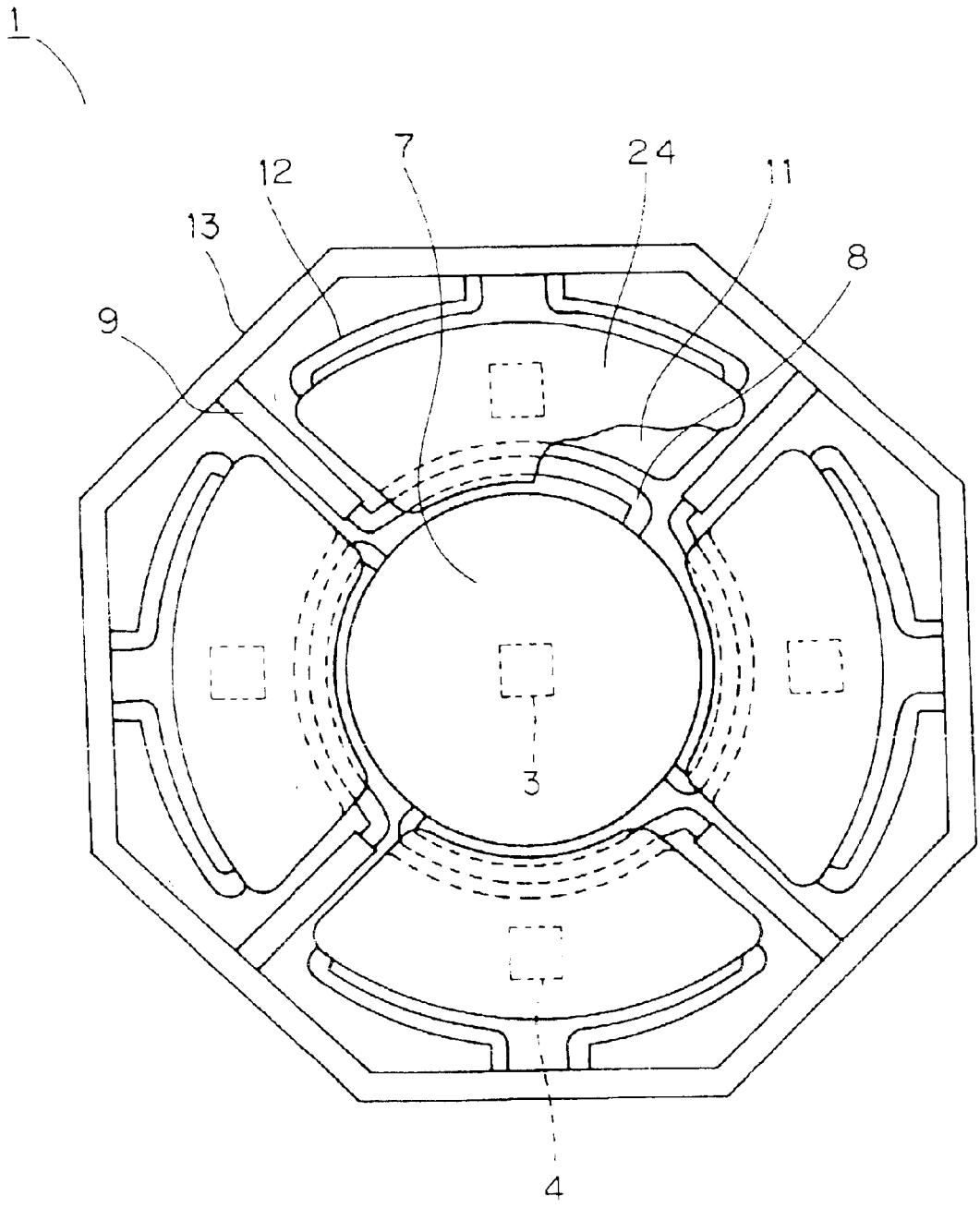
FIG. 11 is a plan view of the key device of a fourth embodiment of the invention.

FIG. 11 is a plan view of the key device of a fourth embodiment of the invention. Here, for convenience' sake, such parts as find their counterparts in the third embodiment shown in FIG. 10 and described above are identified with the same reference numerals. This embodiment differs from the third embodiment in that covers 24 for covering the center hinges 8 are bonded, with adhesive or the like, to the top surfaces of the peripheral key tops 11. In other respects, the structure here is the same as in the third embodiment.

In this embodiment, the same advantages are achieved as in the third embodiment. In addition, covering the center hinges 8 with the covers 24 permits the center key top 7 and the covers 24 to be arranged close together. This helps further enhance the appearance and operability of the key device 1. The covers 24 may be formed integrally with the peripheral key tops 11 into a single member. To avoid complicating the molding process, however, it is preferable to form them as separate members.

Figure 12:
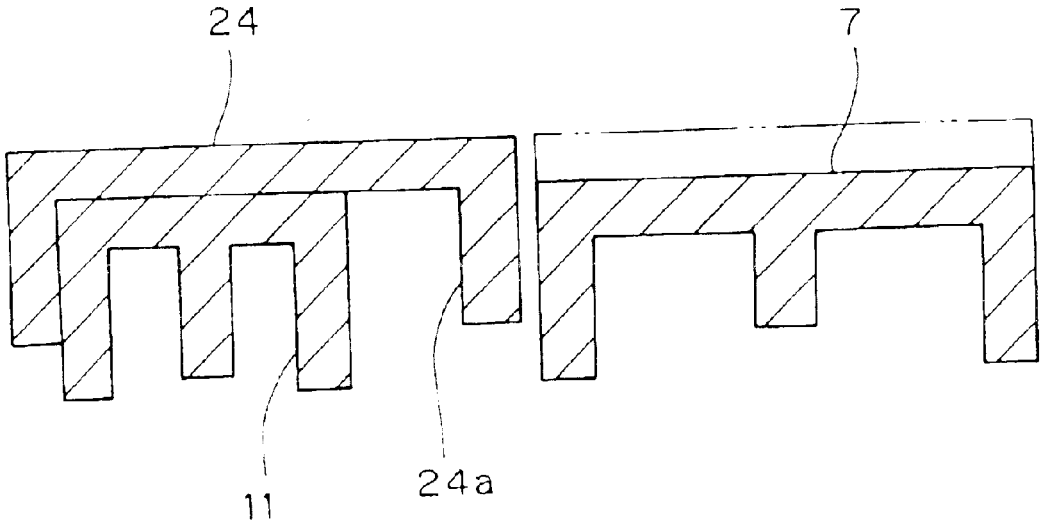
FIG. 12 is a sectional view of a principal portion of the key device of the fourth embodiment.

Moreover, as shown in a sectional view in FIG. 12, the covers 24 each have an edge wall 24*a* formed so as to droop from an edge thereof. When the center key top 7 is pressed, the edge walls 24*a* guide it so as not to incline. When the center key top 7 is released, the edge walls 24a prevent it from being caught by the covers 24. This helps further enhance the operability of the key device 1.

Figure 13:
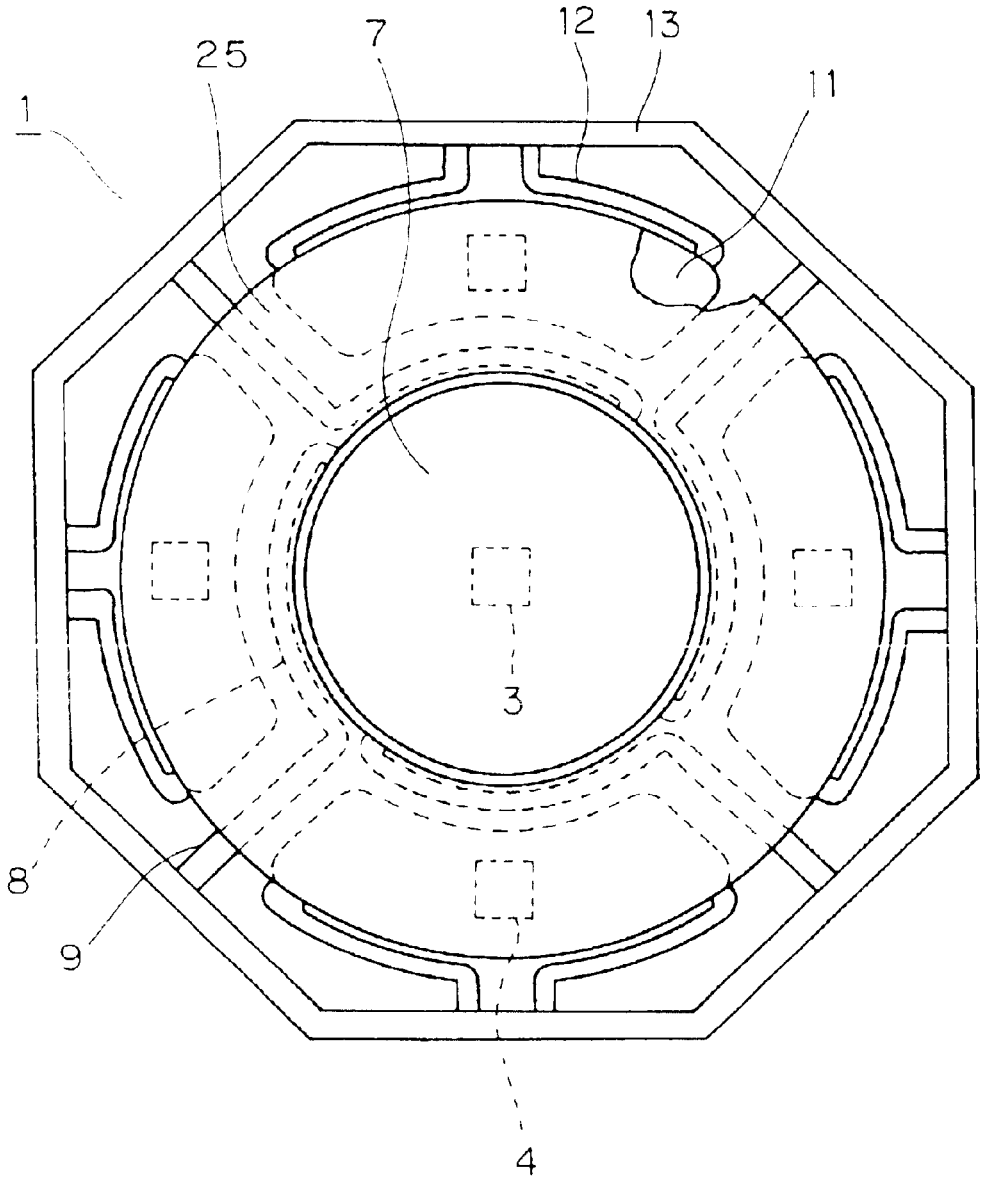
FIG. 13 is a plan view of the key device of a fifth embodiment of the invention.

FIG. 13 is a plan view of the key device of a fifth embodiment of the invention. Here, for convenience' sake, such parts as find their counterparts in the fourth embodiment shown in FIGS. 11 and 12 and described above are identified with the same reference numerals. This embodiment differs from the fourth embodiment in that, instead of the covers 24 (see FIGS. 11 and 12), a ring-shaped cover 25 that links together the top surfaces of the plurality of peripheral key tops 11 is bonded to those surfaces with adhesive or the like. In other respects, the structure here is the same as in the fourth embodiment.

In this embodiment, when part of the cover 25 is pressed, it inclines, pressing the peripheral key top 11 located where the cover 25 is pressed and thereby operating the push switch 4 located below it. Thus, the same advantages are achieved as in the fourth embodiment.

Figure 14:
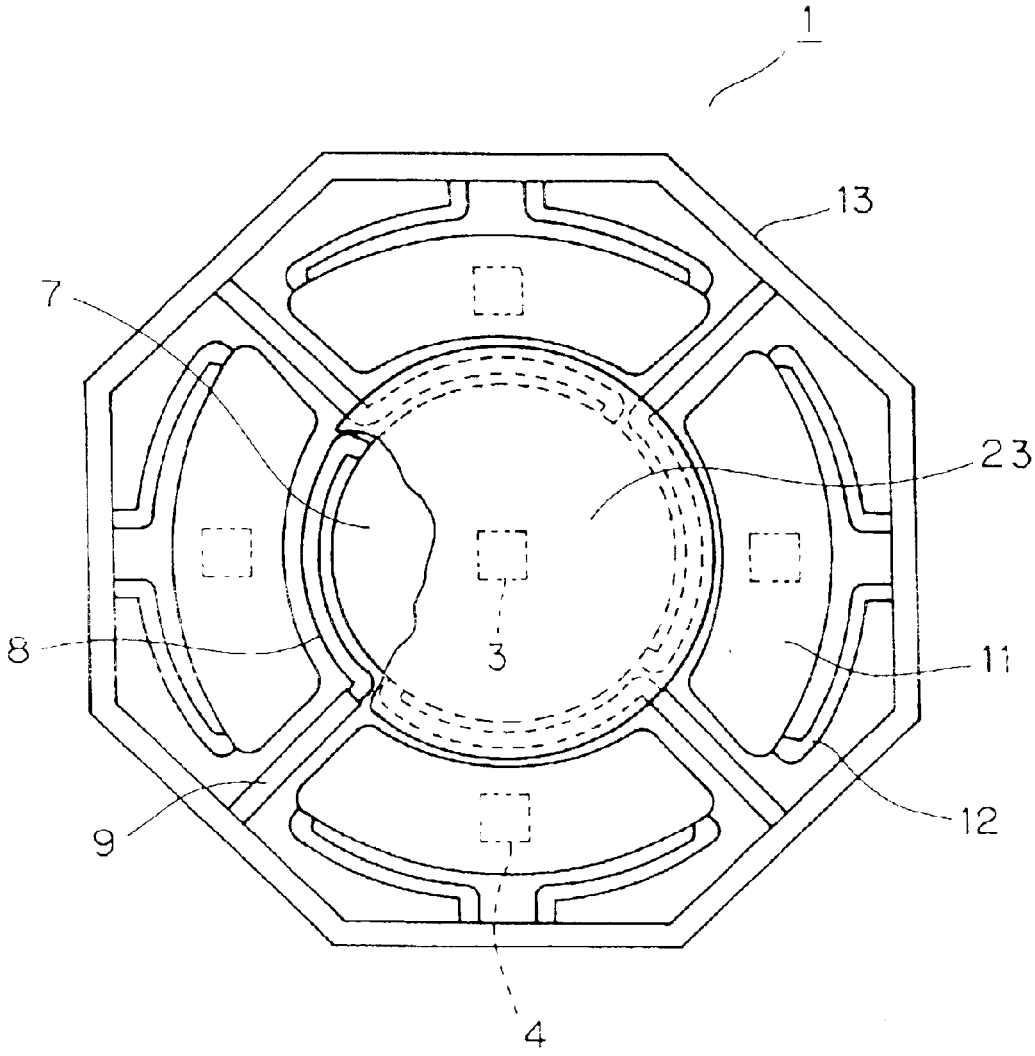
FIG. 14 is a plan view of the key device of a sixth embodiment of the invention.
Figure 15:
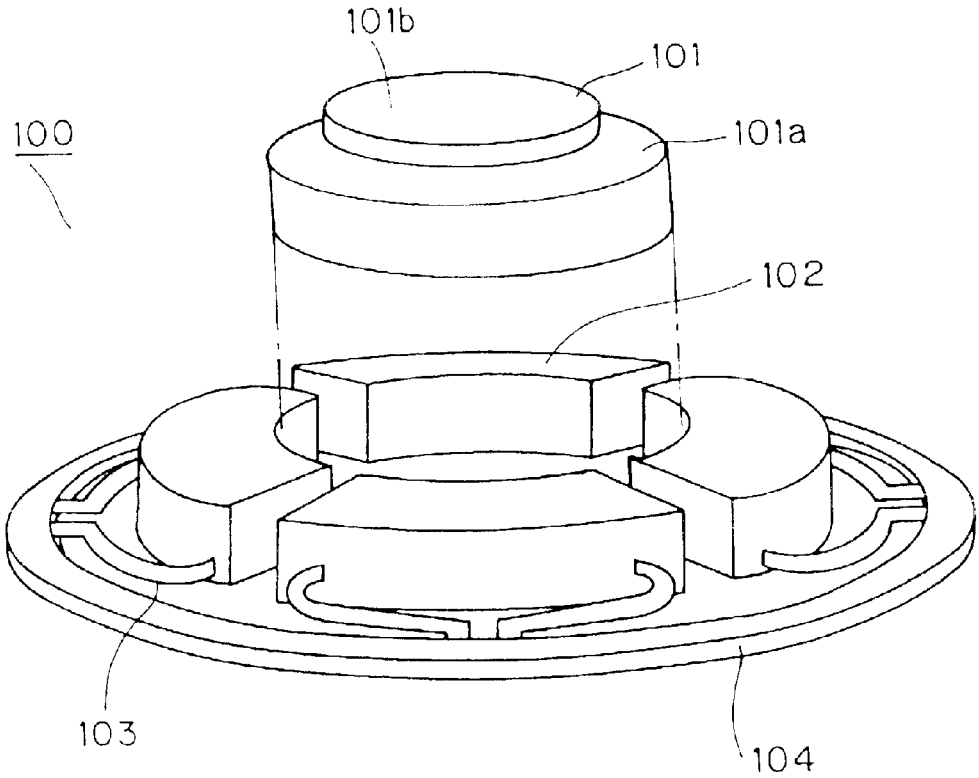
FIG.15 PRIOR ART
FIG. 15 is an exploded perspective view of a conventional key device.
Figure 16:
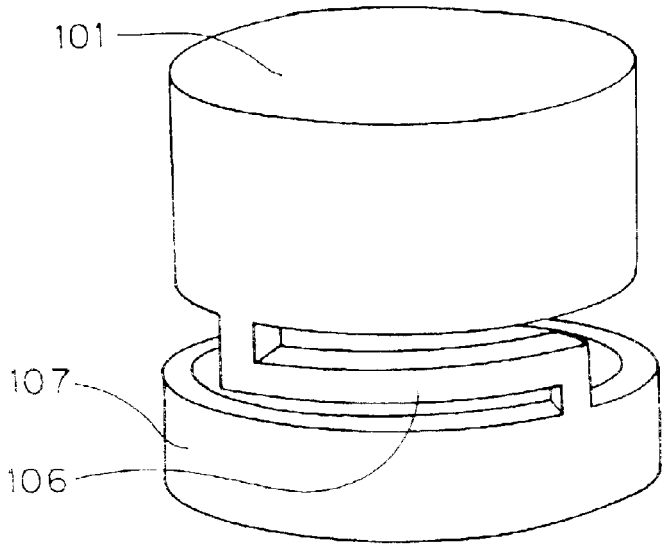
FIG.16 PRIOR ART
FIG. 16 is a perspective view of another example of the center key top of a conventional key device.

FIG. 14 is a plan view of the key device of a sixth embodiment of the invention. Here, for convenience' sake, such parts as find their counterparts in the third embodiment shown in FIG. 10 and described earlier are identified with the same reference numerals. This embodiment differs from the third embodiment in that a cover 23 for covering the center hinges 8 is bonded, with adhesive or the like, to the top surface of the center key top 7. In other respects, the structure here is the same as in the third embodiment.

In this embodiment, the same advantages are achieved as in the third embodiment. In addition, covering the center hinges 8 with the cover 23 permits the peripheral key tops 11 and the cover 23 to be located close together. This helps further enhance the appearance and operability of the key device 1. The cover 23 may be formed integrally with the center key top 7 into a single member. To avoid complicating the molding process, however, it is preferable to form them as separate members. The cover 23 may have an edge wall (see FIG. 12) formed so as to droop from the edge thereof as in the fourth embodiment.

In the first to sixth embodiments described above, the center key top 7 is formed so as to be circular as seen in a plan view; however, it may be formed so as to be polygonal. In the embodiments described above, there are provided four push switches below the peripheral key tops; however, the present invention applies to cases in which there are provided any other number, two or more, of push switches 4 below the peripheral key tops as well.

What is claimed is:

1. A key device having a plurality of peripheral key tops arranged around a center key top so that the key tops, when pressed, operate switches arranged below the key tops respectively, wherein the center key top is elastically supported by a center hinge extending from a center frame provided around the center key top, and the peripheral key tops are provided above the center frame and are each elastically supported by a peripheral hinge extending from a peripheral frame provided around the peripheral key tops.

2. The key device according to claim 1, wherein the plurality of peripheral key tops are integrated together into a single ring-shaped member.

3. The key device according to claim 1, wherein the center hinge is arranged along the circumference of the center key top.

4. The key device according to claim 3, wherein a cover for covering the center hinge is formed so as to extend from a surface of the center key top or of the peripheral key tops.

5. The key device according to claim 4, wherein the cover has an edge thereof so formed as to droop down to form an edge wall.

6. A key device having a plurality of peripheral key tops, each peripheral key top having the shape of a circular portion, arranged around a center key top so that the key tops, when pressed, operate switches arranged below the key tops respectively, wherein the peripheral key tops are each elastically supported by a peripheral hinge extending from a peripheral fame provided around the peripheral key tops, and the center key top is elastically supported by a center hinge that is hinged to the peripheral frame by being laid between adjacent ones of the peripheral key tops.

7. The key device according to claim 6, wherein the plurality of peripheral key tops are integrated together into a single ring-shaped member.

8. The key device according to claim 6, wherein the center hinge is arranged along the circumference of the center key top.

9. The key device according to claim 8, wherein a cover for covering the center hinge is formed so as to extend from a surface of the center key top or of the peripheral key tops.

10. The key device according to claim 9, wherein the cover has an edge thereof so formed as to droop down to form an edge wall.

* * * * *